United States Patent [19]

Baldwin

[11] 3,957,549

[45] May 18, 1976

[54] LOW SIGNATURE PROPELLANTS BASED ON ACRYLIC PREPOLYMER BINDER

[75] Inventor: Mart G. Baldwin, Newtown, Pa.

[73] Assignee: The United States of America as represented by the Secretary of the Army, Washington, D.C.

[22] Filed: June 14, 1974

[21] Appl. No.: 479,401

[52] U.S. Cl. ..... 149/19.91; 149/92; 149/44

[51] Int. Cl.[2] ..... C06B 45/10

[58] Field of Search ..... 149/19.91, 92, 44

[56] References Cited

UNITED STATES PATENTS

| | | | |
|---|---|---|---|
| 3,068,129 | 12/1962 | Schaffel | 149/93 |
| 3,764,418 | 10/1973 | Sayles | 149/92 X |
| 3,770,524 | 11/1973 | Walker et al. | 149/19.91 |
| 3,804,683 | 4/1974 | Baldwin et al. | 149/92 X |
| 3,834,957 | 9/1974 | McDevitt et al. | 149/19.4 |

*Primary Examiner*—Edward A. Miller
*Attorney, Agent, or Firm*—Nathan Edelberg; Robert P. Gibson; Jack W. Voigt

[57] ABSTRACT

A propellant formulation employing an energetic plasticizer, a solid oxidizer, a crosslinking agent, a curing catalyst, a ballistic modifier, and an acrylate - acrylic acid prepolymer binder comprised of about 95 parts of an acrylate selected from petrin acrylate and 2,2′ dinitropropyl acrylate and of about 5 parts of acrylic acid has a low signature (i.e., propellants whose exhaust does not cause serious attenuation of visible, infrared, or radar radiation) while retaining the preferred specific impulse, mechanical properties, processing properties, and other properties of importance in solid propellants. The acrylate-acrylic acid prepolymer serves as the binder for a propellant comprised of an energetic plasticizer selected from butanetriol trinitrate (BTTN), glyceryl trinitrate (NG), and the mixed plasticizers of triethyleneglycol dinitrate (TEGDN), and trimethylolpropane trinitrate (TMETN), a solid oxidizer selected from cyclotetramethylenetetranitramine (HMX), cyclotrimethylenetrinitramine (RDX), and ammonium nitrate, a crosslinking agent, ballistic modifier, and curing catalyst.

3 Claims, No Drawings

LOW SIGNATURE PROPELLANTS BASED ON ACRYLIC PREPOLYMER BINDER

DEDICATORY CLAUSE

The invention described herein may be manufactured, used, and licensed by or for the Government for governmental purposes without the payment to me of any royalties thereon.

BACKGROUND OF THE INVENTION

Considerable background exists for low signature (smokeless) rocket propellants. These propellants include both extruded double-base types and more recently, slurry cast double-base compositions containing a solid organic oxidizer.

The double-base propellant compositions and the slurry cast double-base compositions have been particularly attractive for use in propellants for light assault weapons because of their near-smokelessness, mesa- or plateau-burning characteristics over certain combustion pressure regimes and low temperature coefficients. However, a need exists for a propellant formulation that optimizes specific propellant properties relating to signature properties, specific impulse, mechanical properties, processing properties, and other properties of importance in solid propellants and quantitative testing of propellant exhaust signature properties.

There exists a wide range of applications in the area of tactical military weapons for low-signature, high energy, castable, case-bonded solid rocket propellants.

Accordingly, it is an object of this invention to provide a propellant formulation which can be varied with ease to yield the desired propellant properties through the incorporation of one or more of a wide selection of energetic acrylate monomers into the binder.

Another object of this invention is to provide a low-signature, high energy, castable, case-bondable solid rocket propellant based on copolymerized energetic acrylates having a variety of functional groups in the ester group of the acrylate.

SUMMARY OF THE INVENTION

The low-signature, high energy, castable, case-bondable solid propellant composition of this invention employs an energetic acrylateacrylic acid prepolymer binder along with other high energy compounds to yield a propellant having a theoretical specific impulse (Isp) of 240 to 258. The energetic acrylate which is selected from petrin acrylate and 2,2′ dinitropropyl acrylate is copolymerized with acrylic acid to yield a prepolymer that has the compatibility and the desirable properties required for the processing parameters and for the finished composition.

The propellant prepolymer is readily soluble in several common organic solvents such as petroleum ether, acetone, and the like. The prepolymer is compatible with a preferred high energy plasticizer selected from butanetriol trinitrate, glyceryl trinitrate, and the mixed plasticizers of triethyleneglycol dinitrate and trimethylolpropane trinitrate, a solid oxidizer selected from HMX, RDX, and ammonium nitrate, crosslinking agent, ballistic modifier, and curing catalyst. The easily prepared composition has the desirable high specific impulse while employing ingredients which yield exhaust products of combustion which do not cause serious attenuatiion of transmission of visible, infrared, or radar radiation. Thus, there is no need to employ aluminum and ammonium perchlorate which attribute to the high smoke producing and high attenuating exhaust products produced from an aluminized composite propellant composition in order to achieve a high specific impulse as required in the prior art compositions. For example, a prior art propellant employing ammonium perchlorate and HMX in a combined amount up to about 70 weight percent achieved a specific impulse of about 234, but the smoke-producing exhaust products did not make the composition as attractive for tactical use as one with a higher specific impulse and with substantially no smoke-producing exhaust products or exhaust products that cause serious attenuation of transmission of visible, infrared, or radar radiation.

DESCRIPTION OF THE PREFERRED EMBODIMENT

A low-signature propellant composition which represents a typical formulation of this invention is set forth below.

PROPELLANT COMPOSITION RH-J-14

| Ingredient | Weight Percent |
|---|---|
| Petrin acrylate/acrylic acid prepolymer | 18.5 |
| TEGDN mixed plasticizer | 9.3 |
| TMETN | 18.6 |
| UNOX 221* (crosslinking agent) | 2.4 |
| Ferric acetylacetonate (curing catalyst) | 0.2 |
| HMX, Class B (oxidizer) | 50.0 |
| $Pb_3O_4$ (ballistic agent) | 1.0 |
| | 100.0 |

*4,5-epoxycyclohexylmethyl, 4,5-epoxycyclohexylcarboxylate or diepoxy dicyclohexyl carboxylate and other conventional curing agents such as the aziridines and epoxy types may be used to crosslink the binder materials.

A composition containing a prepolymer comprised of 2,2′ dinitropropyl acrylate of about 95 parts and acrylic acid of about 5 parts, in an amount of about 18.5 weight percent and with like amounts of the other specified propellant ingredients, but using RDX in place of HMX also yields a high specific impulse propellant, low smokiness, and low-signature.

The statement that the above composition with the typical ingredients are of the low-signature type is based on the fact that calculated exhaust species of significant quantities consist only of water, CO and $CO_2$, and nitrogenious products; i.e., the calculated amounts of the exhaust species do not cause serious attenuation of transmission of visible, infrared, or radar radiation.

The petrin acrylate/acrylic acid prepolymer is prepared as follows:

A solution of 95.0 g. petrin acrylate, 5.0 g. acrylic acid, and 1.0 g. benzoyl peroxide in 300 cc ethyl acetate is prepared and heated under reflux conditions for sixteen hours, during which period complete polymerization takes place. The polymer can be obtained from the resulting solution by precipitating into hexane. The polymer is a brittle solid which is also readily soluble in several common organic solvents. The intrinsic viscosity of the polymer in acetone solution at 30° C is 0.13.

Small mixes of propellant were prepared as follows:

To petrin acrylate/acrylic acid prepolymer solution, prepared as described above, were added the appropriate amounts of TEGDN and TMETN, and the solvent was stripped under vacuum. The viscous prepolymer/plasticizer solution was weighed into glass resin kettle and curing agent, catalyst, and solid ingredients were added. The propellant was mixed with a small air motor driven paddle stirrer for two hours at 50°C, and cast into appropriate molds and cured for 40 hours at 60°C. The resulting propellant is a rubbery solid with qualitatively attractive mechanical properties. The burning rate of the propellant at 1000 psi is 0.3 inches/sec., with a pressure exponent of 0.6.

Compositions similar to RH-J-14 can be prepared with theoretical Isps values ranging from about 240 seconds for compositions containing no solid oxidizer to 258 for high HMX, BTTN plasticized systems.

The prepolymer with a ratio of about 90 parts acrylate to about 10 parts acrylic acid is an acceptable range; however the 95/5 ratio is preferred for most formulations. Other acceptable ranges in the composition include a prepolymer as binder 15–20 weight percent, plasticizer 25–30 weight percent, crosslinking agent 1 to 2.5 weight percent, curing catalyst 0.1 to 0.3 weight percent, an organic oxidizer from 50–60 weight percent, and optional ballistic agents from 0.5 to 1.5 weight percent.

The mixed plasticizer, TEGDN and TMETN, are energetic compounds which contribute to the high specific impulse and yield low-signature exhaust products. The ratio of about 1 part of TEGDN with about 2 parts of TMETN is the preferred ratio.

The propellants of this inventon have a wide range of applications in the area of tactical military weapons because of their low-signature, high specific impulse, and their superior mechanical properties which can be achieved from a castable, case-bondable solid rocket propellant. Because of the ease of copolymerization and the compatibility of acrylates in general, a wide selection of propellant ingredients can be employed together in specifically tailored compositions for a particular tactical weapon.

I claim:

1. A solid propellant composition that yields a high specific impulse and exhaust products that are substantially smokeless and with a low-signature, said propellant composition consisting essentially of: a prepolymer binder formulated of about 90–95 parts of an acrylate selected from petrin acrylate and 2,2′ dinitropropyl acrylate and acrylic acid from about 5–10 parts, said binder employed in said composition in amounts from about 15–20 weight percent; a plasticizer selected from butanetroiltrinitrate, glyceryl trinitrate, and the mixed plasticizers of triethyleneglycol dinitrate (TEGDN) and trimethylolpropane trinitrate (TMETN) in amounts from about 25–30 weight percent, said mixed plasticizers being in ratio of about 1 part TEGDN with 2 parts of TMETN; a solid oxidizer selected from cyclotetramethylenetetranitramine, cyclotrimethylenetrinitramine, and ammonium nitrate in amounts from about 50–60 weight percent; a crosslinking agent in an amount from about 1 to about 2.5 weight percent; a curing catalyst in an amount from about 0.1 to about 0.3 weight percent; and a ballistic agent in an amount from about 0.5 to about 1.5 weight percent.

2. The propellant composition of claim 1 wherein said prepolymer binder is formulated of petrin acrylate of about 95 parts and acrylic acid of about 5 parts and said binder is employed in said composition in an amount of about 18.5 weight percent; said plasticizer is said mixed plasticizer comprised of triethyleneglycol dinitrate in an amount of about 9.3 weight percent and trimethylolpropane trinitrate in an amount of about 18.6 weight percent; said crosslinking agent is diepoxy dicyclohexyl carboxylate in an amount of about 2.4 weight percent; said solid oxidizer is cyclotetramethylenetetranitramine in an amount of about 50 weight percent; said curing catalyst is ferric acetylacetonate in an amount of about 0.2 weight percent; and said ballistic agent is $Pb_3O_4$ in an amount of about 1.0 weight percent.

3. The propellant composition of claim 1 wherein said prepolymer binder is formulated of 2,2′ dinitropropyl acrylate of about 95 parts and acrylic acid of about 5 parts and said binder is employed in said composition in an amount of about 18.5 weight percent; said plasticizer is said mixed plasticizer comprised of triethyleneglycol dinitrate in an amount of about 9.3 weight percent and trimethylolpropane trinitrate in an amount of about 18.6 weight percent; said crosslinking agent is diepoxy dicyclohexyl carboxylate in an amount of about 2.4 weight percent; said solid oxidizer is cyclotrimethylenetrinitramine in an amount of about 50 weight percent; said curing catalyst is ferric acetylacetonate in an amount of about 0.2 weight percent; and said ballistic agent is $Pb_3O_4$ in an amount of about 1.0 weight percent.

* * * * *